US006291117B1

(12) United States Patent
Hosaka et al.

(10) Patent No.: US 6,291,117 B1
(45) Date of Patent: Sep. 18, 2001

(54) REVERSIBLE HEAT-SENSITIVE RECORDING MATERIAL

(75) Inventors: Kenichi Hosaka; Jun Maruyama, both of Tokyo (JP)

(73) Assignee: Mitsubishi Paper Mills Ltd., Tokyo (JP)

( * ) Notice: Subject to any disclaimer, the term of this patent is extended or adjusted under 35 U.S.C. 154(b) by 0 days.

(21) Appl. No.: 09/619,496

(22) Filed: Jul. 19, 2000

(30) Foreign Application Priority Data

Jul. 22, 1999 (JP) ..... 11-207130

(51) Int. Cl.[7] ..... B41M 5/26

(52) U.S. Cl. ..... 430/19; 430/945; 430/964; 503/200; 503/216

(58) Field of Search ..... 430/19, 338, 945, 430/964; 503/216, 200

(56) References Cited

U.S. PATENT DOCUMENTS

| | | | | |
|---|---|---|---|---|
| 5,688,592 | | 11/1997 | Shibahashi et al. | 428/323 |
| 5,981,115 | * | 11/1999 | Furuya et al. | 430/19 |

FOREIGN PATENT DOCUMENTS

| | | | |
|---|---|---|---|
| 43-4160 | | 2/1968 | (JP) . |
| 45-14039 | | 5/1970 | (JP) . |
| 54-119377 | | 9/1979 | (JP) . |
| 63-39377 | | 2/1988 | (JP) . |
| 63-41186 | | 2/1988 | (JP) . |
| 63-173684 | | 7/1988 | (JP) . |
| 2-188293 | | 7/1990 | (JP) . |
| 2-188294 | | 7/1990 | (JP) . |
| 4-247985 | | 9/1992 | (JP) . |
| 6-219047 | | 8/1994 | (JP) . |
| 7-290824 | | 11/1995 | (JP) . |
| 8-142513-A | * | 6/1996 | (JP) . |
| 8-282109 | | 10/1996 | (JP) . |
| 9-207437 | | 8/1997 | (JP) . |
| 10-291371-A | * | 11/1998 | (JP) . |
| WO 90/11898 | | 10/1990 | (WO) . |

* cited by examiner

*Primary Examiner*—John A. McPherson
(74) *Attorney, Agent, or Firm*—Nixon & Vanderhye

(57) ABSTRACT

Disclosed is a reversible heat-sensitive recording material which is excellent in light resistance and is remarkably free from discoloration caused by exposure to light and erasing failure and which shows a high layer strength and has durability against repeated printing and erasing, the reversible heat-sensitive recording material having a support, a reversible heat-sensitive recording layer formed on the support and at least one protective layer formed thereon, the reversible heat-sensitive recording layer containing a normally colorless or slightly colored dye precursor and a reversible color developer capable of causing a reversible change in color density of the dye precursor on the basis of a difference in cooling rate after heating, wherein at least one of the said layers contains an isocyanate compound and an ultraviolet absorbent capable of reacting with the isocyanate compound to undergo crosslinking.

6 Claims, No Drawings

REVERSIBLE HEAT-SENSITIVE RECORDING MATERIAL

BACKGROUND OF THE INVENTION

1. Field of the Invention

The present invention relates to a reversible heat-sensitive recording material in which images are formable and erasable by controlling heat energy.

2. Prior Art

A heat-sensitive recording material generally has a support and a heat-sensitive recording layer which is composed mainly of normally colorless or slightly colored electron donating dye precursor and an electron accepting color developer and formed on the support. The dye precursor and the color developer instantaneously react upon application of heat by a thermal head, a thermal pen, laser beams, or the like, to form an image. Such heat-sensitive recording materials are disclosed in Japanese Patent Publications Nos. 43-4160 and 45-14039.

In the above heat-sensitive recording materials, generally, when an image is once formed, it is impossible to erase the image to restore an image portion to its original state. For recording further information, therefore, it is only possible to make recording in a portion where no image is formed. When the area for heat-sensitive recording is limited, there is therefore caused a problem that information that can be recorded is limited, so that not all of the necessary information can be recorded.

For overcoming the above problem, reversible heat-sensitive recording materials capable of repetitive formation and erasure of images have been proposed in recent years. For example, JP-A-54-119377, JP-A-63-39377 and JP-A-63-41186 disclose heat-sensitive recording materials comprising a matrix resin and an organic low-molecular compound dispersed in the matrix resin. In these heat-sensitive recording materials, however, the transparency thereof is reversibly changed, so that the contrast between an imaged portion and an non-imaged portion is insufficient.

There is also proposed a color-forming and color-erasing reversible heat-sensitive recording material on which color formation and color erasure can be repeated. JP-A-2-188293, JP-A-2-188294 and International Patent Publication WO90/11898 disclose reversible heat-sensitive recording materials comprising an electron-donating dye precursor and a color developing and decloring agent for causing the electron-donating dye precursor to form a color upon heating and erasing the color, i.e., a reversible color developer in the present invention.

JP-A-63-173684 and JP-A-4-247985 disclose a reversible heat-sensitive recording material comprising a combination of an electron-donating dye precursor and an ascorbic acid derivative, or a combination of an electron-donating dye precursor and an organic sulfonic acid compound or the like.

The above reversible heat-sensitive recording materials containing an electron-donating dye precursor have various problems caused by the photodecomposition of the electron donating dye precursor itself. That is, when exposed to light such as sunlight or fluorescent lamp light, a non-image portion decreases in whiteness, and the formed color phase of an image portion deteriorates. Further, there is another problem that when an image portion is erased, a non-erasable residue takes place.

In general heat-sensitive recording materials containing a dye precursor, it is general practice to incorporate an ultraviolet absorbent into a protective layer. In reversible heat-sensitive recording materials, however, it produces almost no effect to incorporate an ultraviolet absorbent. That is because general ultraviolet absorbents which undergo no crosslinking with a binder component in a protective layer have a problem that they are crystallized and bleed out after stored for a long period of time and cannot exhibit the capability of ultraviolet absorption. Particularly, in reversible heat-sensitive recording materials on which printing and erasing are repeated, further, an ultraviolet absorbent gradually shifts out of a protective layer, which causes a problem that the capability of ultraviolet absorption decreases and that the reversible heat-sensitive recording layer decreases in printing performance. Further, when a large amount of an ultraviolet absorbent is incorporated for compensating the crystallization and bleed-out of the absorbent, there are caused problems that an image is debased, and that the strength of a layer decreases during repeated printing and erasing due to an increase in the amount of the melting component. In JP-A-9-207437, further, an attempt is made to improve light resistance by adding an ultraviolet-absorbing polymer. However, this polymer has poor compatibility with other components, and the effect of absorbing ultraviolet light is insufficient.

SUMMARY OF THE INVENTION

It is an object of the present invention to provide a reversible heat-sensitive recording material that is capable of the formation and erasure of an image with a good contrast and capable of retaining an image stable with the passage of time under usual living environments, more specifically, a reversible heat-sensitive recording material which is improved in light resistance, which is almost free from discoloration caused by deterioration when exposed to light for a long period of time and erasing failure, and which has high layer strength and has durability against printing and erasure repeated many times.

According to the present invention, the above object of the present invention is achieved by a reversible heat-sensitive recording material having a support, a reversible heat-sensitive recording layer formed on the support and at least one protective layer formed thereon, the reversible heat-sensitive recording layer containing a normally colorless or slightly colored dye precursor and a reversible color developer capable of causing a reversible change in color density of the dye precursor on the basis of a difference in cooling rate after heating, wherein at least one of the said layers contains an isocyanate compound and an ultraviolet absorbent capable of reacting with the isocyanate compound to undergo crosslinking.

The above reversible heat-sensitive recording material is excellent in light resistance and is almost free from discoloration in exposure to light and erasing failure, and the present invention is accordingly completed.

DETAILED DESCRIPTION OF THE INVENTION

The light resistance in the present invention will be explained below. Most reversible heat-sensitive recording materials containing a dye precursor have very low strength against the exposure to visible light or ultraviolet light, and when the reversible heat-sensitive recording materials are exposed to light for a long period of time, an unreacted portion (to be referred to as "ground portion" hereinafter) or an erased portion where a color formed by a reaction is erased (to be referred to as "erased portion" hereinafter) is deteriorated from a colorlessness or a slightly colored state to a brown or other state of a lowered whiteness. Further, a portion where a reaction with a reversible developer has taken place, i.e., a color-formed portion is sometimes converted to a color-formed state different from an original color density, or when the portion is erased after exposed to light, an erased state is incomplete or is deteriorated to have a color density greatly different from the color of the ground portion. The above phenomenon is mainly caused by the decomposition and deterioration of the dye precursor exposed to light. In the reversible heat-sensitive recording material containing such a dye precursor, therefore, it is desired to minimize the above deterioration, i.e., to improve the reversible heat-sensitive recording material in light resistance.

The reversible heat-sensitive recording material referred to in the present invention has a reversible heat-sensitive recording layer composed of at least two components such as a dye precursor and a reversible color developer and has one or more protective layers formed thereon. In the present invention, an ultraviolet absorbent reactive with an isocyanate compound (to be referred to as "reactive ultraviolet absorbent" hereinafter) can be added to any one layer or more of these layers. Since, however, the reactive ultraviolet absorbent needs to be used in combination with an isocyanate compound, these shall be contained in the same layer or layers.

The reactive ultraviolet absorbent undergoes crosslinking with an isocyanate compound to be fixed in a layer, and it does not cause crystallization, bleeding out or interlayer shifting even if printing and erasing are repeated, i.e., even if heating and cooling are repeated. When the above crosslinking is allowed to take place in the presence of a polyolic resin as a binder, the fixing strength of the reactive ultraviolet absorbent and the layer strength increase. Therefore, the added reactive ultraviolet absorbent does not dissipate, and all the reactive ultraviolet absorbent can exhibit the capability of ultraviolet light absorption. There is therefore produced an effect that the reversible heat-sensitive recording material is remarkably improved in light resistance as compared with the case using a conventional ultraviolet absorbent.

The reactive ultraviolet absorbent undergoes crosslinking with an isocyanate compound to be fixed in a layer. The conventional problem is that the ultraviolet absorbent bleeds out and precipitates on a reversible heat-sensitive recording material, so that surface qualities are debased. This problem can be therefore overcome. Further, when a layer is formed thereon, a surface on which the layer is formed neither debases surface qualities nor shows a decrease in adhesion strength. Therefore, the debasing of printing properties of the reversible heat-sensitive recording material can be prevented. Moreover, as the amount of the ultraviolet absorbent is increased, the effect thereof increases. However, it is difficult in conventional practice to add a large amount of the ultraviolet absorbent due to aggregation and precipitation. When the ultraviolet absorbent is added in a large amount, further, there is caused a problem that a layer containing it decreases in transparency, so that the visibility of a formed color in a reversible heat-sensitive recording layer decreases. However, when the reactive ultraviolet absorbent and an isocyanate compound are used in combination, there is produced a characteristic feature that the crystallization and bleeding-out do not take place, and owing to this characteristic feature, the problems of the debasing of surface qualities and a decrease in transparency caused by its precipitation can be avoided even if the amount thereof is increased.

Conventional ultraviolet absorbents are mostly compounds having low molecular weights and low melting points. This means that when these ultraviolet absorbents are used in a reversible heat-sensitive recording material, the amount of a melting component increases in the material which is repeatedly heated and cooled. There is therefore caused a problem that the material has low mechanical strength and shows poor durability when printing and erasing are repeated. In contrast, when the reactive ultraviolet absorbent and an isocyanate compound are used in combination, these are crosslinked, so that no melting component increases in amount. Therefore, the reversible heat-sensitive recording material is improved in the performance of repeated printing and erasing.

The reactive ultraviolet absorbent used in the present invention may be any reactive ultraviolet absorbent so long as it is colorless, white or slightly colored, has the capability of ultraviolet light absorption and is reactive with an isocyanate compound. Specific examples thereof include a hindered amine compound, a benzotriazole compound and a benzophenone compound, while they shall not be limited thereto. A reactive group of the reactive ultraviolet absorbent to an isocyanate compound, there may be employed various groups such as an amino group, a hydroxyl group, a carboxyl group, and the like. Of these, it is more preferred to use a reactive ultraviolet absorbent having a reactive hydroxyl group, in view of the performance of crosslinking.

Further, when a benzotriazole reactive ultraviolet absorbent of the following formula (2) or (3) is used, particularly preferably, the reversible heat-sensitive recording material is remarkably improved in light resistance, layer strength and the performance of repeated printing and erasing.

(2)

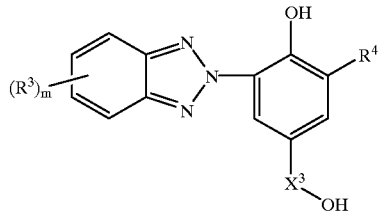

(3)

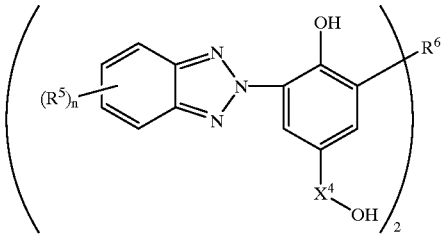

In the formulae (2) and (3), each of m and n is an integer of at least 0 but not more than 4, each of $X^3$ and $X^4$ is a divalent hydrocarbon bonding group, each of $R^3$ and $R^5$ is a halogen atom, a hydrogen atom or a linear or branched alkyl group having 1 to 12 carbon atoms, $R^4$ is a hydrogen atom or a linear or branched alkyl group having 1 to 12 carbon atoms, and $R^6$ is a divalent hydrocarbon bonding group having 1 to 12 carbon atoms.

Although not specially limited, specific examples of the compounds of the formulae (2) and (3) are as follows.

(S-1)

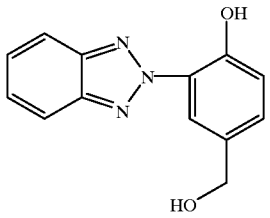

(S-2)

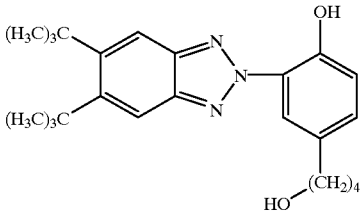

(S-3)

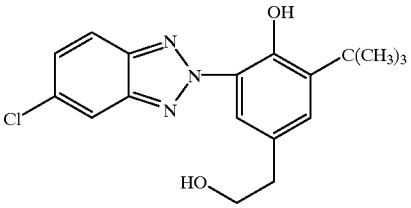

(S-4)

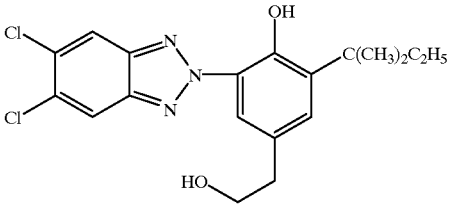

(S-5)

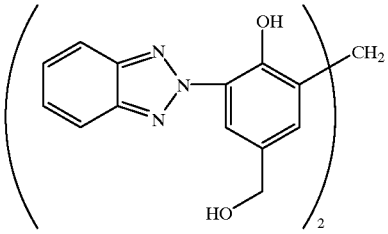

(S-6)

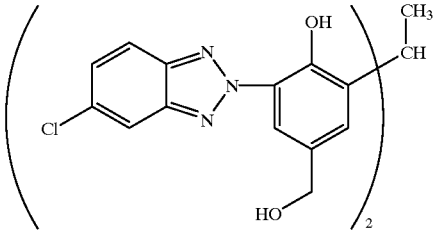

-continued (S-7)

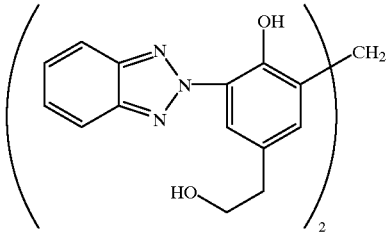

(S-8)

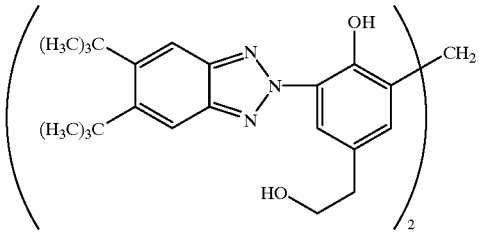

When a light stabilizer is used in addition to the above reactive ultraviolet absorbent, a further higher light resistance can be attained. The light stabilizer includes metal oxides such as zinc oxide and titanium oxide, a hindered phenol compound, a hindered amine compound, a benzotriazole compound, a triazine compound, a benzophenone compound and a benzoate compound, although the light stabilizer shall not be limited thereto.

When both the reactive ultraviolet absorbent and the light stabilizer are added to the same layer, however, the stability of the layer decreases so that physical strength cannot be obtained in some cases. It is therefore preferred to separate a layer containing the reactive ultraviolet absorbent and a layer containing the light stabilizer.

As the reactive ultraviolet absorbent in the present invention, one reactive ultraviolet absorbent or a mixture of two or more reactive ultraviolet absorbents may be used. The amount of the reactive ultraviolet absorbent based on the normally colorless or slightly colored dye precursor in the present invention is 5 to 6,000% by weight, preferably 10 to 4,000% by weight.

In the present invention, the crosslinking isocyanate compound includes toluene diisocyanate, hexamethylene diisocyanate, methylene diisocyanate, p-phenylene diisocyanate, triphenylmethane triisocyanate, 4,4'-biphenylene diisocyanate and derivatives of these, although the crosslinking isocyanate shall not be limited thereto.

In the present invention, the isocyanate compounds may be used alone or in combination. The amount of the reactive ultraviolet absorbent based on the isocyanate compound is 0.1 to 500% by weight, preferably 0.3 to 100% by weight.

The reversible developer for use in the present invention is not critical so long as it causes a reversible change in color density of the dye precursor when heated. However, it is particularly preferred to use an electron-accepting compound of the following formula (1), since the heat-sensitive recording material is excellent in various properties such as color formation and decoloration and is remarkably improved in light resistance.

(1)

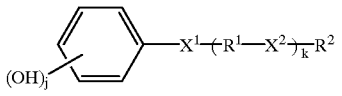

wherein j is an integer of at least 1 but not greater than 3, k is 0 or 1, $X^1$ is a single bond, an oxygen atom, a sulfur atom or a divalent group having at least one —CONH— bond, $X^2$ is a divalent bond having at least one —CONH— bond, $R^1$ is a divalent hydrocarbon group having 1 to 18 carbon atoms, and $R^2$ is a hydrocarbon group which has 1 to 24 carbon atoms and may contain an oxygen atom or a sulfur atom in its chain.

In the formula (1), $R^1$ is a divalent hydrocarbon group having 1 to 18 carbon atoms, preferably a divalent hydrocarbon group having 1 to 11 carbon atoms. $R^2$ is a hydrocarbon group having 1 to 24 carbon atoms, preferably a hydrocarbon group having 6 to 22 carbon atoms. Further, particularly preferably, the total sum of the number of carbon atoms of $R^1$ and $R^2$ is at least 11 but not greater than 35. Specifically, each of the hydrocarbon groups represented by $R^1$ and $R^2$ is mainly an alkylene group or an alkyl group, while each group may contain an aromatic ring. In the case of $R^1$ in particular, the hydrocarbon group may be formed of aromatic ring(s) alone. Each of $X^1$ and $x^2$ is a divalent group having at least one —CONH— bond. Specific examples thereof include amide (—CONH—, —NHCO—), urea (—NHCONH—), urethane (—NHCOO—, —OCONH—), diacylamine (—COHNCO—), diacylhydrazide (—CONHNHCO—), oxalic diamide (—NHCOCONH—), acylurea (—CONHCONH—, —NHCONHCO—), 3-acylcarbazinic acid ester (—CONHNHCOO—), semicarbazide (—NHCONHNH—, —NHNHCONH—), acylsemicarbazide (—CONHNHCONH—, —NHCONHNHCO—), diacylaminomethane (—$CONHCH_2NHCO$—), 1-acylamino-1-ureidomethane (—$CONHCH_2NHCONH$—, —$NHCONHCH_2NHCO$—) and malonamide (—$NHCOCH_2CONH$—). Further, $X^1$ may be an oxygen atom or a sulfur atom alone.

Specific examples of the compound of the formula (1) are as follows, while the compound of the formula (1) shall not be limited thereto.

(D-1)

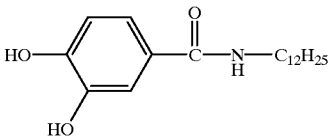

(D-2)

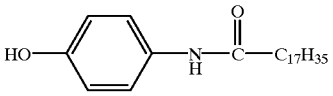

(D-3)

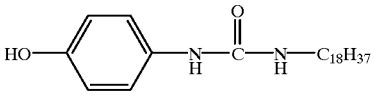

-continued (D-4)

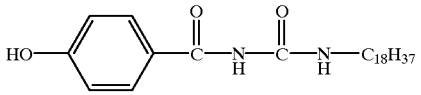

(D-5)

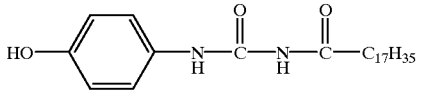

(D-6)

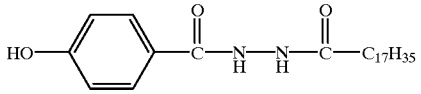

(D-7)

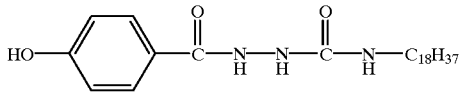

(D-8)

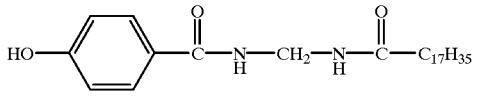

(D-9)

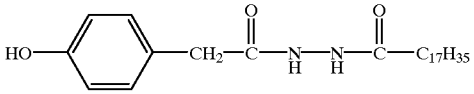

(D-10)

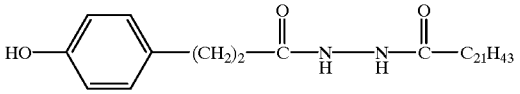

(D-11)

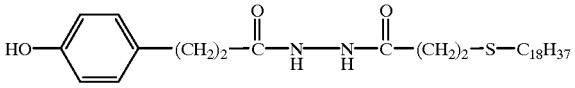

(D-12)

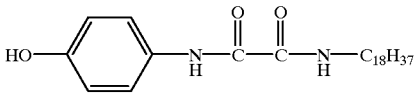

(D-13)

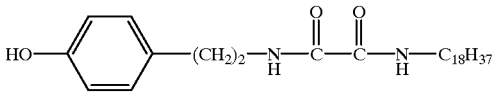

(D-14)

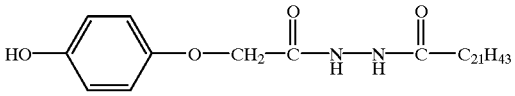

(D-15)

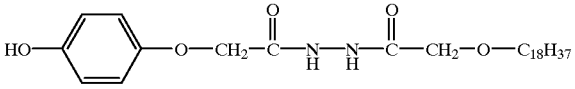

-continued
(D-16)
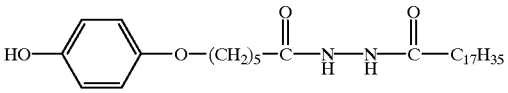
(D-17)
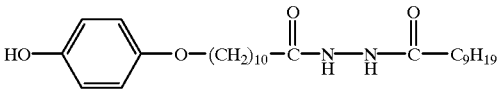
(D-18)
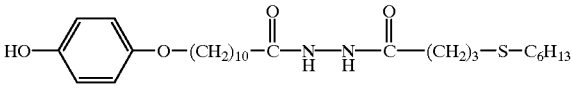
(D-19)
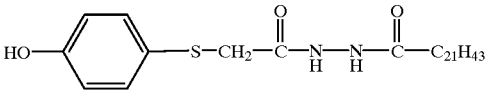
(D-20)
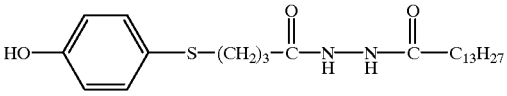
(D-21)
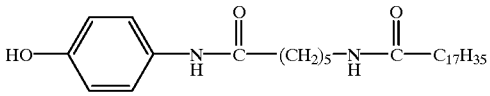
(D-22)
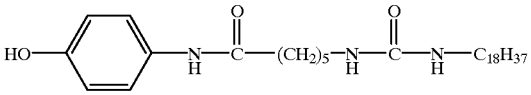
(D-23)
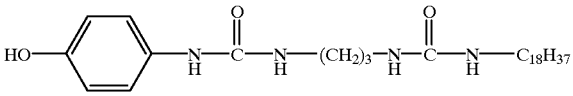
(D-24)
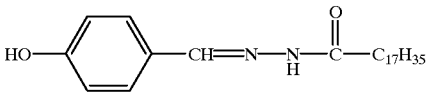
(D-25)
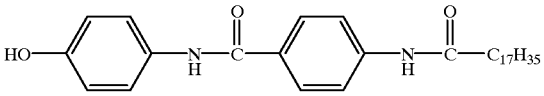
(D-26)
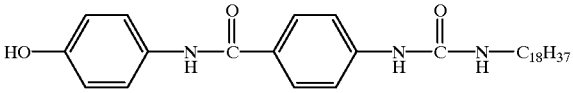
-continued
(D-27)
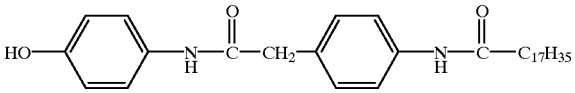
(D-28)
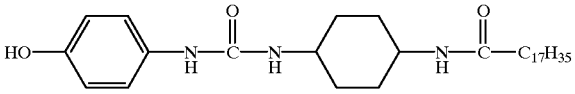
(D-29)
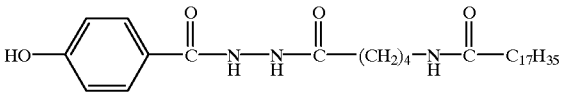
(D-30)
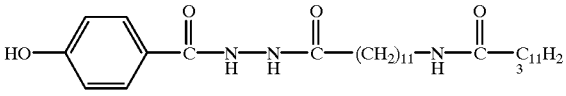
(D-31)
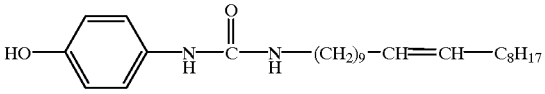
(D-32)
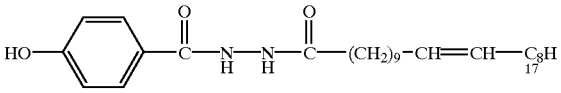
(D-33)
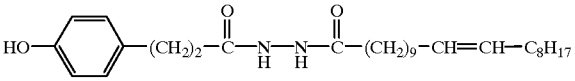
(D-34)
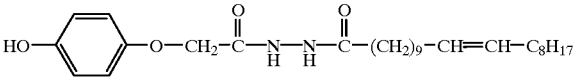
(D-35)
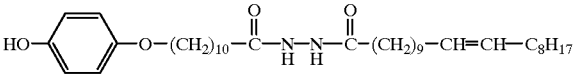
(D-36)
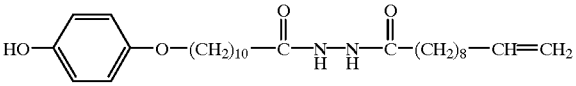
(D-37)
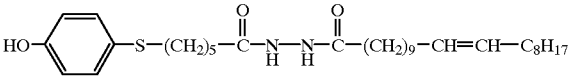
(D-38)
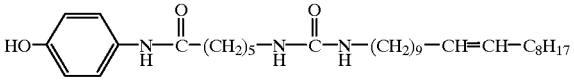

-continued (D-39)

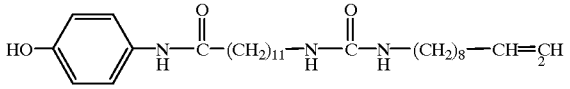

(D-40)

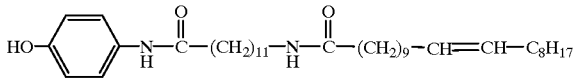

In the present invention, the electron accepting compounds may be used alone or in combination. The amount of the electron accepting compound based on the normally colorless or slightly colored dye precursor is 5 to 5,000% by weight, preferably 10 to 3,000% by weight.

The normally colorless or slightly colored electron donating dye precursor for use in the present invention can be typically selected from those generally used in pressure-sensitive recording papers and heat-sensitive recording papers, while it shall not be specially limited. Specific examples of the above dye precursor are as listed below, while the above dye precursor shall not be limited thereto.

(1) Triarylmethane Compounds 3,3-bis(p-dimethylaminophenyl)-6-dimethylaminophthalide (Crystal Violet Lactone), 3,3-bis(p-dimethylaminophenyl)phthalide, 3-(4-diethylamino-2-ethoxyphenyl)-3-(1-ethyl-2-methylindol-3-yl)phthalide, 3-(p-dimethylaminophenyl)-3-(2-methylindol-3-yl) phthalide, 3-(p-dimethylaminophenyl)-3-(2-phenylindol-3-yl)phthalide, 3,3-bis(1,2-dimethylindol-3-yl)-5-dimethylaminophthalide, 3,3-bis(1,2-dimethylindol-3-yl)-6-dimethylaminophthalide, 3-(4-diethylamino-2-ethoxyphenyl)-3-(1-ethyl-2-methylindol-3-yl)-4-azaphthalide, 3,3-bis(9-ethylcarbazol-3-yl)-5-dimethylaminophthalide, 3,3-bis(2-phenylindol-3-yl)-5-dimethylaminophthalide, and 3-p-dimethylaminophenyl-3-(1-methylpyrrol-2-yl)-6-dimethylaminophthalide.

(2) Diphenylmethane Compounds 4,4,'-bis(dimethylaminophenyl)benzhydryl benzyl ether, N-chlorophenylleucoauramine, and N-2,4,5-trichlorophenylleucoauramine.

(3) Xanthene Compounds

Rhodamine B anilinolactam, Rhodamine B-p-chloroanilinolactam, 3-diethylamino-7-dibenzylaminofluoran, 3-diethylamino-7-octylaminofluoran, 3-diethylamino-7-phenylfluoran, 3-diethylamino-7-chlorofluoran, 3-diethylamino-6-chloro-7-methylfluoran, 3-diethylamino-7-phenoxyfluoran, 3-diethylamino-7-(3,4-dichloroanilino)fluoran, 3-diethylamino-7-(2-chloroanilino)fluoran, 3-diethylamino-6-methyl-7 -anilinofluoran, 3-diethylamino-6-methyl-7-(3-methylanilino)fluoran, 3-(N-ethyl)tolylamino-6-methyl-7-anilinofluoran, 3-piperidino-6-methyl-7-anilinofluoran, 3-(N-ethyl)tolylamino-6-methyl-7-phenethylfluoran, 3-diethylamino-7-(4-nitroanilino)fluoran, 3-dibutylamino-6-methyl-7-anilinofluoran, 3-(N-methyl)propylamino-6-methyl-7-anilinofluoran, 3-(N-ethyl)isoamylamino-6-methyl-7-anilinofluoran, 3-(N-methyl)cyclohexylamino-6-methyl-7-anilinofluoran, and 3-(N-ethyl) tetrahydrofurylamino-6-methyl-7-anilinofluoran.

(4) Thiazine Compounds

Benzoyl Leucomethylene Blue, p-Nitrobenzoyl Leucomethylene Blue (5) Spyro Compounds 3-Methylspirodinaphthopyran, 3-ethylspirodinaphthopyran, 3,3,'-dichlorospirodinaphthopyran, 3-benzylspirodinaphthopyran, 3-methylnaphtho-(3-methoxybenzo)spiropyran, and 3-propylspirobenzopyran.

The above normally colorless or slightly colored dye precursors may be used alone or in combination.

The method of producing the reversible heat-sensitive recording material of the present invention will specifically explained hereinafter, while the method thereof in the present invention shall not be limited thereto.

In a specific method of producing the reversible heat-sensitive recording material of the present invention, the normally colorless or slightly colored dye precursor and the electron accepting compound are used as main components, and these are applied or printed on a support to form a reversible heat-sensitive recording layer.

Although not specially limited, the method of incorporating the normally colorless or slightly colored dye precursor and the electron-accepting compound into the reversible heat-sensitive recording layer includes a method in which these compounds are separately dissolved in separate solvents or dispersed in separate dispersing media and the solutions or dispersions are mixed, a method in which these compounds are mixed and the mixture is dissolved in a solvent or dispersed in a dispersing medium, a method in which the compounds are melted under heat to form a homogeneous mixture and the mixture is cooled and then dissolved in a solvent or dispersed in a dispersing medium.

For improving the strength of the reversible heat-sensitive recording layer, the reversible heat-sensitive recording layer may contain a binder. Specific examples of the binder include water-soluble polymers such as starches, hydroxyethylcellulose, methylcellulose, carboxymethylcellulose, gelain, casein, polyvinyl alcohol, denatured polyvinyl alcohol, sodium polyacrylate, an acryl amide/acrylic ester copolymer, an acryl amide/acrylic ester/methacrylic acid terpolymer, an alkali salt of a styrene/maleic anhydride copolymer and an alkali salt of a ethylene/maleic anhydride copolymer, and latexes such as polyvinyl acetate, polyurethane, polyacrylic ester, a styrene/butadiene copolymer, an acrylonitrile/butadiene copolymer, a methyl acrylate/butadiene copolymer, an ethylene/vinyl acetate copolymer, an ethylene/vinyl chloride copolymer, polyvinyl chloride, an ethylene/vinylidene chloride copolymer and polyvinylidene chloride. The function of the binder is to produce a state where the components of the composition are homogeneously dispersed without forming partial aggregates under heat applied for printing and erasing. The binder resin is therefore preferably selected from resins having high heat resistance. Reversible heat-sensitive recording materials having high addition values such as prepaid cards, stored cards, etc., come to be used recently, and the reversible heat-sensitive recording materials have accordingly come to be required to have high durability in heat resistance, water resistance and adhesion. For such requirements, a setting resin is particularly preferred.

The setting resin includes a thermosetting resin, an electron-beam-setting resin and an ultraviolet-light-setting resin. The thermosetting resin includes resins of which hydroxyl groups or carboxyl groups react with a crosslinking agent to undergo setting, such as a phenoxy resin, a polyvinyl butyral resin and a cellulose acetate propionate resin. The above crosslinking agent is selected, for example, from isocyanates, amines, phenols and epoxys.

Monomers for the electron-beam- and ultraviolet-light-setting resins include monofunctional monomers, difunctional monomers and polyfunctional monomers typified by acrylic monomers. For crosslinking with ultraviolet light in particular, a photopolymerization initiator or a photopolymerization promoter is used.

As an additive for adjusting the color formation sensitivity and the decoloration temperature of the reversible heat-sensitive recording layer, the reversible heat-sensitive recording layer may contain a heat-melting substance. A heat-melting substance having a melting point of 60 to 200° C. is preferred, and a heat-melting substance having a melting point of 80 to 180° C. is particularly preferred. A sensitizer used for general heat-sensitive recording papers may be used. Examples of these substances include waxes such as N-hydroxymethylstearic acid amide, stearic acid amide and palmitic acid amide, naphthol derivatives such as 2-benzyloxynaphthalene, biphenyl derivatives such as p-benzylbiphenyl and 4-allyloxybiphenyl, polyether compounds such as 1,2-bis(3-methylphenoxy)ethane, 2,2'-bis(4-methoxyphenoxy)diethyl ether and bis(4-methoxyphenyl) ether, and carbonic or oxalic acid diester derivatives such as diphenyl carbonate, dibenzyl oxalate and bis(p-methylbenzyl) oxalate.

The support for use in the reversible heat-sensitive recording material of the present invention can be selected from paper, various non-woven fabrics, woven fabrics, a synthetic resin film, a synthetic resin laminated paper, a synthetic paper, a metal foil, glass and composite sheets formed of combinations of these as required. Further, the support may be transparent, semi-transparent or non-transparent. Further, the support shall not be limited to the above materials.

In the layer structure of the reversible heat-sensitive recording material of the present invention, an intermediate layer may be provided between the reversible heat-sensitive recording layer and the support. In this case, the protective layer and/or the intermediate layer may be composed of a plurality of layers such as two layers or 3 layers or more. Further, the reversible heat-sensitive recording layer and/or other layer and/or a surface on which the reversible heat-sensitive recording layer is formed and/or a surface opposite thereto may contain a material in which information can be electrically, magnetically or optically recorded. Moreover, for preventing curling and antistatic charge, a back coat layer may be provided on the surface opposite to the surface where the reversible heat-sensitive recording layer is formed.

The reversible heat-sensitive recording layer can be formed by a method in which color-forming components are finely pulverized to prepare dispersions, the dispersions are mixed and the mixture is applied or printed on the support and dried, or by a method in which color-forming components are dissolved in solvents to prepare solutions, the solutions are mixed and the mixture is applied or printed on the support and dried. In this case, there may be employed a constitution in which one color-forming component is incorporated into one layer and other color-forming component is incorporated to other layer to form a multi-layered structure.

Further, the reversible heat-sensitive recording layer and/or the protective layer and/or the intermediate layer may contain a pigment such as diatomaceous earth, talc, kaolin, calcined kaolin, calcium carbonate, magnesium carbonate, titanium oxide, zinc oxide, silicon oxide, aluminum hydroxide or a urea-formalin resin, a salt of a higher fatty acid such as zinc stearate or calcium stearate, a wax such as paraffin, paraffin oxide, polyethylene, polyethylene oxide, stearic acid amide or a caster wax, a dispersing agent such as sodium dioctylsulfosuccinate, a surfactant and a fluorescent dye.

In the reversible heat-sensitive recording material of the present invention, an image of a color can be formed by rapid cooling which follows heating, and the formed image can be erased by cooling a heated portion at a low rate after heating. For example, after heating is carried out by a proper method, a heated portion is rapidly cooled by pressing a low-temperature metal block, or the like thereto, whereby a color formed state is exhibited.

Further, when heating is carried out for a very short time period with a thermal head or laser beam, a heated portion is immediately cooled after heated, so that a color formed state can be retained. On the other hand, when the reversible heat-sensitive recording material is heated for a relatively long time period with a proper heating means (thermal head, laser beam, hot roll, hot stamping, high-frequency heating, electrical heater, radiant heat from a tungsten lamp or a halogen lamp or hot air), not only the reversible heat-sensitive recording layer but also the support is heated, and the cooling rate is therefore low after the heating means is removed, so that a decolored state is restored. Even when the same heating temperature and/or the same heating means are/is used, therefore, a color formed state and a decolored state can be exhibited as required.

EXAMPLES

The present invention will be explained in detail with reference to Examples hereinafter. In Examples, "part" and "%" stand for "part by weight" and "% by weight". Main ultraviolet absorbents of the following formulae (E-1) to (E-5) were used in Examples.

(E-1)

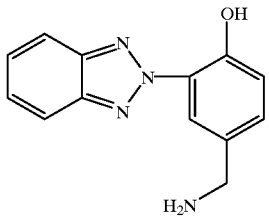

(E-2)

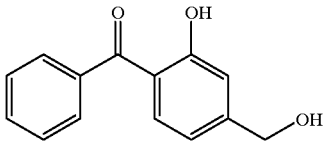

(E-3)

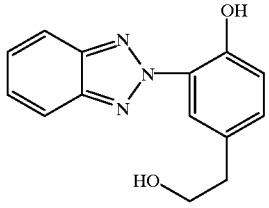

-continued (E-4)

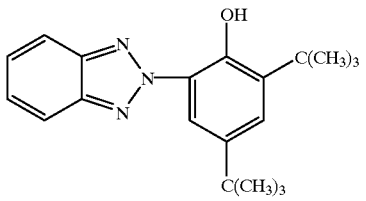

(E-5)

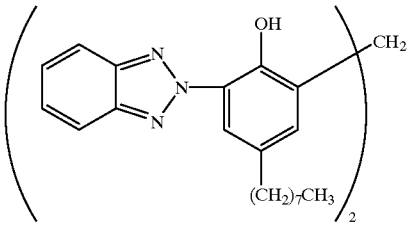

Example 1

(A) Preparation of Reversible Heat-sensitive Coating Color

4 Parts of 3-diethylamino-6-methyl-7 -anilinofluoran, 16 parts of a reversible developer shown as a compound of the formula (D-3), 16 parts of a vinyl chloride-vinyl acetate copolymer (trade name; VYHH, supplied by Union Carbide) as a binder resin, 80 parts of toluene as a solvent and 80 parts of methyl ethyl ketone as a solvent were milled with a bench ball mill for 48 hours, to prepare a reversible heat-sensitive coating color.

(B) Preparation of Protective Layer Coating Color

Parts of an ultraviolet absorbent shown as a compound of the formula (E-1), 20 parts of a polyester polyol resin (trade name; Nippolan 800, supplied by Nippon Polyurethane Kogyo K.K.), 40 parts of a polyisocyanate resin (trade name; Coronate L, supplied by Nippon Polyurethane Kogyo K.K.), 100 parts of toluene as a solvent and 100 parts of methyl ethyl ketone as a solvent were milled with a bench ball mill for 48 hours, to prepare a protective layer coating color.

The reversible heat-sensitive coating color prepared in (A) was applied onto a 188 $\mu$m thick polyethylene terephthalate (PET) sheet so as to form a coating having a solid content of 5 g/m$^2$, and dried. Then, the protective layer coating color prepared in (B) was coated thereon so as to form a coating having a solid content of 1 g/m$^2$ and dried at 100° C. for 10 hours, whereby a reversible heat-sensitive recording material was obtained.

Example 2

(C) Preparation of Reversible Heat-sensitive Coating Color

A reversible heat-sensitive coating color was prepared in the same manner as in (A) of Example 1 except that the reversible developer shown as a compound of the formula (D-3) was replaced with a reversible developer shown as a compound of the formula (D-17).

(D) Preparation of Protective Layer Coating Color

A protective layer coating color was prepared in the same manner as in (B) of Example 1 except that the ultraviolet absorbent shown as a compound of the formula (E-1) was replaced with an ultraviolet absorbent shown as a compound of the formula (E-2).

The reversible heat-sensitive coating color prepared in (C) was applied onto a 188 $\mu$m thick polyethylene terephthalate (PET) sheet so as to form a coating having a solid content of 5 g/m$^2$, and dried. Then, the protective layer coating color prepared in (D) was coated thereon so as to form a coating having a solid content of 1 g/m$^2$, and dried at 100° C. for 10 hours, whereby a reversible heat-sensitive recording material was obtained.

Example 3

(E) Preparation of Protective Layer Coating Color

A protective layer coating color was prepared in the same manner as in (B) of Example 1 except that the ultraviolet absorbent shown as a compound of the formula (E-1) was replaced with an ultraviolet absorbent shown as a compound of the formula (E-3).

The reversible heat-sensitive coating color prepared in (C) of Example 2 was applied onto a 188 $\mu$m thick polyethylene terephthalate (PET) sheet so as to form a coating having a solid content of 5 g/m$^2$, and dried. Then, the protective layer coating color prepared in (E) was coated thereon so as to form a coating having a solid content of 1 g/m$^2$, and dried at 100° C. for 10 hours, whereby a reversible heat-sensitive recording material was obtained.

Example 4

(F) Preparation of Protective Layer Coating Color

A protective layer coating color was prepared in the same manner as in (B) of Example 1 except that the ultraviolet absorbent shown as a compound of the formula (E-1) was replaced with an ultraviolet absorbent shown as a compound of the formula (S-7).

The reversible heat-sensitive coating color prepared in (C) of Example 2 was applied onto a 188 $\mu$m thick polyethylene terephthalate (PET) sheet so as to form a coating having a solid content of 5 g/m$^2$, and dried. Then, the protective layer coating color prepared in (F) was coated thereon so as to form a coating having a solid content of 1 g/m$^2$, and dried at 100° C. for 10 hours, whereby a reversible heat-sensitive recording material was obtained.

Example 5

(G) Preparation of Reversible Heat-sensitive Coating Color

A reversible heat-sensitive coating color was prepared in the same manner as in (A) of Example 1 except that the reversible developer shown as a compound of the formula (D-3) was replaced with a reversible developer shown as a compound of the formula (D-22).

(H) Preparation of Protective Layer Coating Color

A protective layer coating color was prepared in the same manner as in (B) of Example 1 except that the ultraviolet absorbent shown as a compound of the formula (E-1) was replaced with an ultraviolet absorbent shown as a compound of the formula (S-8).

The reversible heat-sensitive coating color prepared in (G) was applied onto a 188 $\mu$m thick polyethylene terephthalate (PET) sheet so as to form a coating having a solid content of 5 g/m$^2$, and dried. Then, the protective layer coating color prepared in (H) was coated thereon so as to form a coating having a solid content of 1 g/m$^2$, and dried at 100° C. for 10 hours, whereby a reversible heat-sensitive recording material was obtained.

Example 6

(I) Preparation of Reversible Heat-sensitive Coating Color

A reversible heat-sensitive coating color was prepared in the same manner as in (A) of Example 1 except that the reversible developer shown as a compound of the formula (D-3) was replaced with a reversible developer shown as a compound of the formula (D-10).

The reversible heat-sensitive coating color prepared in (I) was applied onto a 188 μm thick polyethylene terephthalate (PET) sheet so as to form a coating having a solid content of 5 g/m$^2$, and dried. Then, the protective layer coating color prepared in (F) of Example 4 was coated thereon so as to form a coating having a solid content of 1 g/m$^2_1$ and dried at 100° C. for 10 hours, whereby a reversible heat-sensitive recording material was obtained.

Example 7

(J) Preparation of Reversible Heat-sensitive Coating Color

A reversible heat-sensitive coating color was prepared in the same manner as in (A) of Example 1 except that the reversible developer shown as a compound of the formula (D-3) was replaced with a reversible developer shown as a compound of the formula (D-19).

(K) Preparation of Protective Layer Coating Color

A protective layer coating color was prepared in the same manner as in (B) of Example 1 except that the ultraviolet absorbent shown as a compound of the formula (E-1) was replaced with an ultraviolet absorbent shown as a compound of the formula (S-1).

The reversible heat-sensitive coating color prepared in (J) was applied onto a 188 μm thick polyethylene terephthalate (PET) sheet so as to form a coating having a solid content of 5 g/m$^2$, and dried. Then, the protective layer coating color prepared in (K) was coated thereon so as to form a coating having a solid content of 1 g/m$^2$, and dried at 100° C. for 10 hours, whereby a reversible heat-sensitive recording material was obtained.

Example 8

(L) Preparation of Protective Layer Coating Color

10 Parts of an ultraviolet absorbent shown as a compound of the formula (S-7), 10 parts of ultrafine particles of zinc oxide, 20 parts of a polyester polyol resin (trade name; Nippolan 800, supplied by Nippon Polyurethane Kogyo K.K.), 40 parts of a polyisocyanate resin (trade name; Coronate L, supplied by Nippon Polyurethane Kogyo K.K.), 100 parts of toluene as a solvent and 100 parts of methyl ethyl ketone as a solvent were milled with a bench ball mill for 48 hours, to prepare a protective layer coating color.

The reversible heat-sensitive coating color prepared in (C) of Example 2 was applied onto a 188 μm thick polyethylene terephthalate (PET) sheet so as to form a coating having a solid content of 5 g/m$^2$, and dried. Then, the protective layer coating color prepared in (L) was coated thereon so as to form a coating having a solid content of 1 g/m$^2$, and dried at 100° C. for 10 hours, whereby a reversible heat-sensitive recording material was obtained.

Example 9

(M) Preparation of Second Protective Layer Coating Color

10 Parts of ultrafine particles of zinc oxide, 20 parts of a polyester polyol resin (trade name; Nippolan 800, supplied by Nippon Polyurethane Kogyo K.K.), 40 parts of a polyisocyanate resin (trade name; Coronate L, supplied by Nippon Polyurethane Kogyo K.K.), 100 parts of toluene as a solvent and 100 parts of methyl ethyl ketone as a solvent were milled with a bench ball mill for 48 hours, to prepare a protective layer coating color.

The reversible heat-sensitive coating color prepared in (C) of Example 2 was applied onto a 188 μm thick polyethylene terephthalate (PET) sheet so as to form a coating having a solid content of 5 g/m$^2$, and dried. Then, the protective layer coating color prepared in (F) of Example 4 was coated thereon so as to form a coating having a solid content of 1 g/m$^2$, and further, the protective layer coating color prepared in (M) was coated thereon so as to form a coating having a solid content of 1 g/m$^2$, and dried at 100° C. for 10 hours, whereby a reversible heat-sensitive recording material was obtained.

Comparative Example 1

(N) Preparation of Protective Layer Coating Color

A protective layer coating color was prepared in the same manner as in (B) of Example 1 except that the ultraviolet absorbent shown as a compound of the formula (E-1) was replaced with an ultraviolet absorbent shown as a compound of the formula (E-4), which was non-crosslinkable with isocyanate.

The reversible heat-sensitive coating color prepared in (C) of Example 2 was applied onto a 188 μm thick polyethylene terephthalate (PET) sheet so as to form a coating having a solid content of 5 g/m$^2$, and dried. Then, the protective layer coating color prepared in (N) was coated thereon so as to form a coating having a solid content of 1 g/m$^2$, and dried at 100° C. for 10 hours, whereby a reversible heat-sensitive recording material was obtained.

Comparative Example 2

(O) Preparation of Protective Layer Coating Color

A protective layer coating color was prepared in the same manner as in (B) of Example 1 except that the ultraviolet absorbent shown as a compound of the formula (E-1) was replaced with an ultraviolet absorbent shown as a compound of the formula (E-5), which was non-crosslinkable with isocyanate.

The reversible heat-sensitive coating color prepared in (C) of Example 2 was applied onto a 188 μm thick polyethylene terephthalate (PET) sheet so as to form a coating having a solid content of 5 g/m$^2$, and dried. Then, the protective layer coating color prepared in (O) was coated thereon so as to form a coating having a solid content of 1 g/m$^2$, and dried at 100° C. for 10 hours, whereby a reversible heat-sensitive recording material was obtained.

Comparative Example 3

(P) Preparation of Protective Layer Coating Color

10 Parts of an ultraviolet absorbent shown as a compound of the formula (S-7), 20 parts of a vinyl chloride-vinyl acetate copolymer (trade name; VYHH, supplied by Union Carbide) as a binder resin, 100 parts of toluene as a solvent and 100 parts of methyl ethyl ketone as a solvent were milled with a bench ball mill for 48 hours, to prepare a protective layer coating color.

The reversible heat-sensitive coating color prepared in (C) of Example 2 was applied onto a 188 μm thick polyethylene terephthalate (PET) sheet so as to form a coating having a solid content of 5 g/m$^2$, and dried. Then, the protective layer coating color prepared in (P) was coated thereon so as to form a coating having a solid content of 1 g/m$^2$, and dried at 100° C. for 10 hours, whereby a reversible heat-sensitive recording material was obtained.

Comparative Example 4

(Q) Preparation of Protective Layer Coating Color

10 Parts of a styrene copolymer of 2-(2'-hydroxy-5'-methacryloxyethylphenyl)-2H-benzotriazole (trade name; PUVA30S, supplied by Otsuka Chemical Co., Ltd.), 20 parts of a vinyl chloride-vinyl acetate copolymer (trade name; VYHH, supplied by Union Carbide) as a binder resin, 100 parts of toluene as a solvent and 100 parts of methyl ethyl ketone as a solvent were milled with a bench ball mill for 48 hours, to prepare a protective layer coating color.

The reversible heat-sensitive coating color prepared in (C) of Example 2 was applied onto a 188 $\mu$m thick polyethylene terephthalate (PET) sheet so as to form a coating having a solid content of 5 g/m$^2$, and dried. Then, the protective layer coating color prepared in (Q) was coated thereon so as to form a coating having a solid content of 1 g/m$^2$, and dried at 100° C. for 10 hours, whereby a reversible heat-sensitive recording material was obtained.

Test 1 (Light Resistance Test with Fluorescent Light)

Printing was carried out on each of the reversible heat-sensitive recording materials obtained in Examples 1 to 9 and Comparative Examples 1 to 4 with a thermal facsimile printing tester (TH-PMD, supplied by Okura Denki) having a printing head (KJT-256-8MGF1, supplied by Kyocera Co.) under conditions of a printing pulse of 1.1 msec and an applied voltage of 26 V. Part of a printed portion of each material was erased by heating with a hot stamp at 120° C. for 1 second, to prepare printed and erased samples. The thus-prepared printed and erased samples were measured for densities in a printed portion, an erased portion and a ground portion of each sample with a densitometer (Macbeth RD918). As an exposure test, further, the printed and erased samples were exposed to fluorescent light at 10,000 luxes for 50 hours, and after the exposure, part of the printed portion of each sample was erased by heating with a hot stamp at 120° C. for 1 second. Then, the printed and erased samples were similarly measured for densities in a printed portion, an erased portion and a ground portion of each sample. Table 1 shows the results.

Test 2 (Observation of Reversible Heat-sensitive Recording Material on which Printing and Erasing Were Repeated 500 Times)

Printing was carried out on each of the reversible heat-sensitive recording materials obtained in Examples 1 to 9 and Comparative Examples 1 to 4 with a thermal facsimile printing tester (TH-PMD, supplied by Okura Denki) having a printing head (KJT-256-8MGF1, supplied by Kyocera Co.) under conditions of a printing pulse of 1.1 msec and an applied voltage of 26 V. The thus-obtained formed color images were measured for densities with a densitometer (Macbeth RD918). Then, the printed portions were erased by heating with a hot stamp at 120° C. for 1 second, and the eased portions were similarly measured for densities. Further, printing and erasing were repeated on the same portions 500 times. Then, the surface state of each reversible heat-sensitive recording material was visually observed. Table 2 shows the results.

Table 1

TABLE 1

| | Printed portion | | Erased portion | | Ground | |
|---|---|---|---|---|---|---|
| | Before exposure | after exposure | Before exposure | after exposure | Before exposure | after exposure |
| Ex. 1 | 1.43 | 1.35 | 0.06 | 0.08 | 0.06 | 0.07 |
| Ex. 2 | 1.51 | 1.43 | 0.07 | 0.09 | 0.06 | 0.07 |
| Ex. 3 | 1.52 | 1.49 | 0.07 | 0.09 | 0.06 | 0.08 |
| Ex. 4 | 1.49 | 1.42 | 0.06 | 0.08 | 0.06 | 0.08 |
| Ex. 5 | 1.22 | 1.18 | 0.08 | 0.09 | 0.08 | 0.08 |
| Ex. 6 | 1.35 | 1.30 | 0.05 | 0.06 | 0.05 | 0.06 |
| Ex. 7 | 1.55 | 1.46 | 0.08 | 0.09 | 0.06 | 0.07 |
| Ex. 8 | 1.51 | 1.45 | 0.06 | 0.07 | 0.06 | 0.06 |
| Ex. 9 | 1.50 | 1.49 | 0.06 | 0.06 | 0.06 | 0.06 |
| CEx. 1 | 1.45 | 0.65 | 0.06 | 0.53 | 0.06 | 0.47 |
| CEx. 2 | 1.48 | 0.58 | 0.06 | 0.48 | 0.06 | 0.42 |
| CEx. 3 | 1.50 | 0.34 | 0.07 | 0.36 | 0.07 | 0.33 |
| CEx. 4 | 1.48 | 0.44 | 0.06 | 0.38 | 0.06 | 0.34 |

Ex. = Example, CEx. = Comparative Example

TABLE 2

| | Visual observation* |
|---|---|
| Example 1 | A |
| Example 2 | A |
| Example 3 | A |
| Example 4 | AA |
| Example 5 | AA |
| Example 6 | AA |
| Example 7 | AA |
| Example 8 | A |
| Example 9 | AA |
| Comparative Example 1 | B–C |
| Comparative Example 2 | B–C |
| Comparative Example 3 | C |
| Comparative Example 4 | C |

*Note: AA: Excellent, A: Good, B: Poor, C: Extremely poor

As explained above, the present invention provides a reversible heat-sensitive recording material having a support, a reversible heat-sensitive recording layer formed on the support and at least one protective layer formed thereon, the reversible heat-sensitive recording layer containing a normally colorless or slightly colored dye precursor and a reversible color developer capable of causing a reversible change in color density of the dye precursor on the basis of a difference in cooling rate after heating, wherein at least one of the said layers contains an isocyanate compound and an ultraviolet absorbent capable of reacting with the isocyanate compound to undergo crosslinking. The above reversible heat-sensitive recording material is excellent in light resistance, is remarkably free from discoloration caused by exposure to light and erasing failure, shows a high layer strength and has durability against repeated printing and erasing.

What is claimed is:

1. A reversible heat-sensitive recording material having a support, a reversible heat-sensitive recording layer formed on the support and at least one protective layer formed thereon, the reversible heat-sensitive recording layer containing a normally colorless or slightly colored dye precursor and a reversible color developer capable of causing a reversible change in color density of the dye precursor on the basis of a difference in cooling rate after heating, wherein at least one of the said layers contains an isocyanate compound and an ultraviolet absorbent capable of reacting with the isocyanate compound to undergo crosslinking.

2. The reversible heat-sensitive recording material of claim 1, wherein the reversible color developer has the following formula (1), (1)

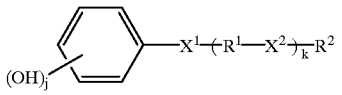

wherein j is an integer of at least 1 but not greater than 3, k is 0 or 1, $X^1$ is a single bond, an oxygen atom, a sulfur atom or a divalent group having at least one —CONH— bond, $X^2$ is a divalent bond having at least one —CONH— bond, $R^1$ is a divalent hydrocarbon group having 1 to 18 carbon atoms, and $R^2$ is a hydrocarbon group which has 1 to 24 carbon atoms and may contain an oxygen atom or a sulfur atom in its chain.

3. The reversible heat-sensitive recording material of claim 1, wherein the ultraviolet absorbent is a compound having a reactive hydroxy group.

4. The reversible heat-sensitive recording material of claim 1, wherein ultraviolet absorbent has the following formula (2) or (3), (2)

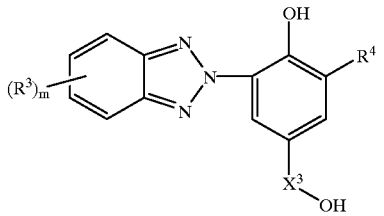

(3)

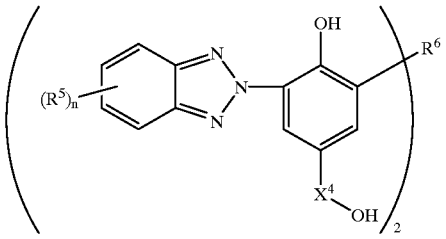

wherein each of m and n is an integer of at least 0 but not more than 4, each of $X^3$ and $X^4$ is a divalent hydrocarbon bonding group, each of $R^3$ and $R^5$ is a halogen atom, a hydrogen atom or a linear or branched alkyl group having 1 to 12 carbon atoms, $R^4$ is a hydrogen atom or a linear or branched alkyl group having 1 to 12 carbon atoms, and $R^6$ is a divalent hydrocarbon bonding group having 1 to 12 carbon atoms.

5. The reversible heat-sensitive recording material of claim 1, wherein at least one layer contains a light stabilizer.

6. The reversible heat-sensitive recording material of claim 5, wherein the ultraviolet absorbent and the light stabilizer are contained in different layers.

* * * * *